United States Patent [19]

McMillan

[11] Patent Number: 4,500,811

[45] Date of Patent: Feb. 19, 1985

[54] ELECTRIC LAMP WITH EXTERNAL FUSE LEAD

[75] Inventor: John E. McMillan, Kirtland, Ohio

[73] Assignee: General Electric Company, Schenectady, N.Y.

[21] Appl. No.: 479,786

[22] Filed: Mar. 28, 1983

[51] Int. Cl.[3] ..... H01J 7/44; H01J 17/34; H01H 85/04

[52] U.S. Cl. ..... 315/58; 315/74; 337/290

[58] Field of Search ..... 315/58, 71, 74; 337/31; 337/290

[56] References Cited

U.S. PATENT DOCUMENTS

| | | | |
|---|---|---|---|
| 2,147,584 | 2/1939 | Thomas | 337/31 X |
| 3,253,179 | 5/1966 | Edwards et al. | 313/318 |
| 4,208,603 | 6/1980 | Graves et al. | 313/1 |
| 4,398,124 | 8/1983 | Kohl et al. | 315/74 |
| 4,415,836 | 11/1983 | DeCuester et al. | 315/74 X |

FOREIGN PATENT DOCUMENTS

| | | | |
|---|---|---|---|
| 56-174 | 11/1982 | Japan | 337/290 |

*Primary Examiner*—Palmer Demeo

*Attorney, Agent, or Firm*—John F. McDevitt; Philip L. Schlamp; Fred Jacob

[57] ABSTRACT

An electric lamp construction is described having at least one pair of conductive inlead wires of dispersion strengthened copper alloy to serve as the sole means of the physical support for a resistive incandescent filament physically connected thereto, and wherein one of said inlead wires is further electrically connected to a fuse lead of a copper solution alloy with nickel and tin. Said fuse metal produces less metal arc damage when melted during the lamp operation as compared with other fuse metals now in commercial use.

9 Claims, 2 Drawing Figures

ELECTRIC LAMP WITH EXTERNAL FUSE LEAD

BACKGROUND OF THE INVENTION

This invention relates generally to electric lamps utilizing one or more resistive incandescent filaments as the illumination source and wherein said illumination source is physically connected to at least one pair of conductive inlead wires of dispersion strengthened copper alloy serving as the sole means of physical support for said illumination source. Electric lamps of this type are described in U.S. Pat. No. 4,208,603, assigned to the assignee of the present invention, with said inlead construction exhibiting improved stiffness sufficient to eliminate the need for additional support of the incandescent filament by the previously employed tie wire elements. An incandescent electric lamp having said improved inlead construction includes a transparent envelope with a stem press seal region at one end containing the said resistive incandescent filament phsyically connected to a pair of conductive inlead wires of dispersion strengthened copper alloy providing said physical support and with said inlead wires extending through said stem press seal region. In a different incandescent lamp construction, the transparent envelope contains a pair of resistive incandescent filaments and two pair of conductive inlead wires of dispersion strengthened copper alloys serving as the sole support for each incandescent filament, and with one inlead wire of each pair of inlead wires being connected together in common for lamp operation at different levels of illumination. A third type electric lamp is also described in said prior art patent utilizing an outer transparent envelope which contains at least one resistive incandescent filament and an inner sealed arc tube as separate illumination sources and with said incandescent illumination sources being connected to a pair of conductive inlead wires of dispersion strengthened copper alloy serving again as the sole means of physical support for said illumination sources.

It has longer been known to provide fuse leads in various type electric lamps to avoid the arc damage caused if abnormally high electrical currents are applied to the lamp. Said fuse leads generally operate toward the end of lamp life, when the filament fails during lamp operation and commonly forms an arc, thereby resulting in increased current flow which causes the fuse lead wire to be blown or ruptured. The rupturing of the fuse often causes spattering of molten metal and metallic vapor throughout the stem press region of the lamp envelope with resultant violent arcing and likelihood of damage to the lamp and to the socket in which the lamp is mounted. A commonly employed form of such fuse lead is a wire of nickel or copper-silicon alloy physically joined to one of the lamp inleads in the stem press region of the lamp envelope.

Excessive lamp arc damage is still being experienced with conventional fuse leads due to spattering of the molten metal inside the lamp envelope. While protective sleeves have also been employed over the fuse leads to ameliorate this problem, the attendant cost and effort in adding such further protective means is understandably not very satisfactory. Fuse metals also melt at various rates dependent upon the lamp current and with faster melting action minimizing arc damage in the lamp. It would be advantageous, therefore, to provide improved fuse leads demonstrating faster melting rates especially at higher current levels and which do not spatter excessively when melted.

SUMMARY OF THE INVENTION

It has now been discovered that fuse lead wires of a copper solution alloy with nickel and tin provide all of the foregoing advantages when employed as more particularly hereinafter described in the lamp construction. While special fuse lead requirements are not dictated in the aforementioned type electric lamps, it will be apparent that any failure of the resistive incandescent filament requires reliable operation of the fuse lead. The melting and sensitivity characteristics of the presently discovered fuse metal provides the desired degree of reliable fuse operation in these type lamps over a broad range of lamp wattage sizes and physical locations of this lamp component. Tests have shown the present fuse leads to be superior in performance to the commercial nickel or copper silicon alloys now being used in incandescent lamps for general illumination while demonstrating other advantages when employed to replace more sensitive fuse metals in other type electric lamps.

The present lamp improvement utilizes a transparent envelope with a stem press seal region at one end which contains a resistive incandescent filament physically connected to a pair of conductive inlead wires of dispersion strengthened copper alloy serving as a sole means of physical support for said resistive incandescent filament, said inlead wires extending through said stem press seal, and one of said inlead wires further being electrically connected to a fuse lead of a copper solution alloy with nickel and tin external of said stem press seal region. A representative copper solution alloy for said fuse lead construction comprises in weight percent approximately 77% copper, approximately 15% nickel, and approximately 8% tin and with said metal alloy being sold by the Bridgeport Brass Company as Cunistan 15-8. In the customary lamp construction, said dispersion strengthened copper alloy inleads are further physically joined to dumet metal inleads in the stem press seal region of said lamp envelope. A preferred incandescent lamp of this type further employs a stem press seal construction for the inleads comprising a glass mount member being sealed at one end to a lamp glass envelope and terminating at the opposite end in a pressed seal portion providing a direct hermetic seal to both inleads. In a different lamp of this general type for operation at different levels of illumination and which is fully described in the aforementioned U.S. Pat. No. 4,208,603, the transparent lamp envelope contains a pair of resistive incandescent filaments and two pair of conductive inlead wires of dispersion strengthened copper alloy serving as the sole physical support for both resistive incandescent filaments and being connected thereto so that each pair of inlead wires is connected to one of said resistant incandescent filaments and one inlead wire of each pair of inlead wires is connected together in common thereby permitting said filaments to be illuminated individually or together.

A still different type electric lamp advantageously employing the present improvement is also more fully described in the aforementioned U.S. Pat. No. 4,208,603. Said lamp includes an outer transparent envelope with a stem press seal at one end which contains at least one resistive incandescent filament and an inner sealed arc tube as separate illumination sources and with each of said incandescent illumination sources being physically connected to a pair of conductive inlead wires of dispersion strengthened copper alloy serving as the sole means of physical support for said illumination sources, said inlead wires extending through said stem press seal and one of said inlead wires further being electrically connected to a fuse lead of a copper solution alloy with nickel and tin external of said press seal region. In a preferred embodiment, all inleads are further electrically connected to a circuitboard member external of said lamp envelope and which is housed in the lamp base and with said fuse lead also being electrically connected to said circuitboard member. Again, said dispersion strengthened copper alloy inleads in the preferred lamp construction are further joined to dumet metal inleads in a stem press seal region of said outer transparent envelope.

DETAILED DESCRIPTION OF THE PREFERRED EMBODIMENTS

Figure 1:
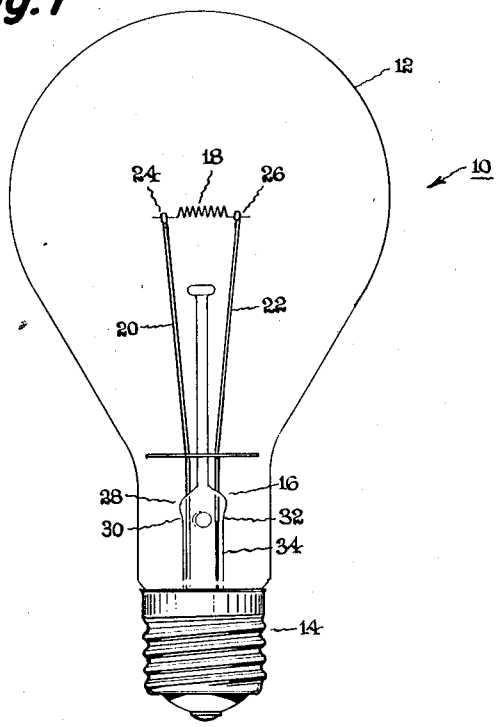
FIG. 1 depicts in cross section an incandescent lamp constructed in accordance with the present invention.

Referring to FIG. 1, there is shown in cross section incandescent lamp 10 of conventional design having a transparent envelope 12, commonly made of glass, which is secured to a base member 14 providing a housing assembly for a mount construction 16 supporting a resistive incandescent filament 18 that serves as the illumination source of said lamp. An inert gas or vacuum (not shown) is further provided within the sealed transparent envelope, conventionally made of glass to protect against filament oxidation during lamp operation and the filament material is generally tungsten or some other suitable refractory metal including alloys thereof. For the purposes of this invention, the term "transparent" being used to characterize the lamp envelope signifies the ability to transmit visible light and conventional incandescent lamps include coloration of the envelope material as well as coating the lamp envelope with materials which diffuse or reflect light. A particular mount construction 16 being depicted utilizes inlead wires 20 and 22 of dispersion strengthened copper alloy which would serve as the sole means of physically supporting said resistive incandescent filament and with one end of each of said inlead wires 24 and 26, respectively, being physically connected to opposite ends of the resistive incandescent filament 18. The other ends of said inlead wires 20 and 22 extend through a stem press seal region 28 of the glass mount construction 16 to provide a direct hermetic seal to both inleads. Short lengths 30 and 32 of said inlead wires are customarily formed of dumet metal, that consists of a nickel-iron core in a copper sleeve and exhibits approximately the same coefficient of expansion as glass in order to provide said direct hermetic seal to both inleads at the stem press seal region of the lamp envelope. The remaining length 34 of one inlead which is located external of said stem press seal region constitutes the improved fuse lead component in the present lamp construction. As can be further noted, said glass mount construction is sealed directly to a restricted neck portion of the lamp glass envelope.

Figure 2:
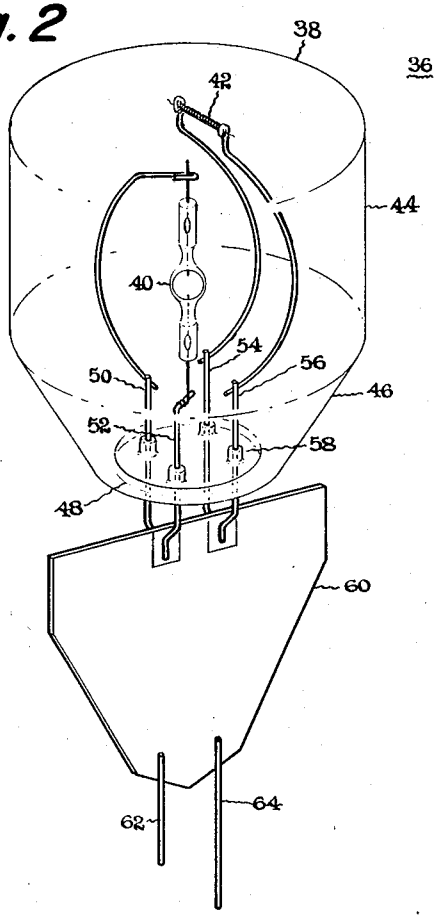
FIG. 2 depicts in cross section a different type electric lamp having both an inner sealed arc tube and a resistive lamp filament to serve a separate illumination source and with the fused lead component for said lamp being made in accordance with the present invention.

In FIG. 2 there is depicted a different type of electric lamp 36 having an outer transparent envelope 38 which contains an inner sealed arc tube 40 along with a resistive incandescent filament 42 serving as separate illumination sources in said lamp. Said outer transparent lamp envelope 38 can further include a bulb portion 44 along with a restricted neck portion 46 for direct sealing to a disc-like disclosure element 48 and all of said members can be constructed of glass. Said disc-like closure member 48 which serves as the base of the depicted lamp glass envelope further provides the only structural support for both illumination sources in the lamp. Specifically, said base mount member 48 includes one pair of inlead wires 50 and 52 which are formed with nickel and are electrically connected to and provide the physical support for said sealed arc tube 40 whereas a second pair of said inlead wires 54 and 56 formed with dispersion strengthened copper alloy provide comparable suspension of the incandescent filament coil 42 and with all four of said inleads being hermetically sealed within said outer glass envelope 38. Again, the outwardly extending ends of said inlead wires in the press seal region 58 of said lamp glass envelope are constructed with dumet metal in order to provide direct hermetic sealing to the inlead wires. A circuitboard member 60 is electrically connected to the terminal ends of said inlead wires external of said press seal region and lamp glass envelope, said circuitboard having the ballast means for said lamp construction. Said circuit board member and ballast means are of otherwise known conventional construction and are physically housed in a metal base member for this lamp (not shown). Further electrical connection of said circuitboard member and ballast means to the lamp base member is also conventional and provided by terminal lead wires 62 and 64. Terminal lead wire 64 provides the fused lead component in said lamp construction and is formed with a fuse metal in accordance with the present invention.

It will be apparent to those skilled in the art that various modifications may be made in the specific lamp constructions above described which are still within the spirit and scope of the present invention. For example other lamp configurations than above specifically disclosed can benefit by incorporation of the presently improved fuse lead members as a substitute for other copper and nickel alloys now being used for said purpose. It is intended to limit the present invention, therefore, only by the scope of the following claims.

What I claim as new and desire to secure by Letters Patent of the United States is:

1. An electric lamp having a transparent envelope with a stem press seal region at one end which contains a resistive incandescent filament physically connected to a pair of conductive inlead wires of dispersion-strengthened copper alloy serving as the sole means of physical support for said resistive incandescent filament, said inlead wires extending through said stem press seal, and one of said inlead wires further being electrically connected to a fuse lead of a copper solution alloy with nickel and tin external of said stem press seal region.

2. An electric lamp as in claim 1 wherein the copper solution alloy comprises in weight percent approximately 77% copper, approximately 15% nickel, and approximately 8% tin.

3. An electric lamp as in claim 1 wherein said dispersion-strengthened copper alloy inleads are further joined to dumet metal inleads in the stem press seal region.

4. An electric lamp as in claim 1 wherein said stem press seal for the inleads comprises a glass mount construction being sealed at one end to a glass envelope and terminating at the opposite end in a pressed seal portion providing a direct hermetic seal to both inleads.

5. An electric lamp as in claim 1 wherein the transparent envelope contains a pair of resistive incandescent filaments and two pair of conductive inlead wires of dispersion strengthened copper alloy serving as the sole physical support for said resistive incandescent filaments.

6. An electric lamp having an outer transparent envelope with a stem press seal region at one end which contains at least one resistive incandescent filament and an inner sealed arc tube as separate illumination sources and with said incandescent illumination source being physically connected to a pair of conductive inlead wires of dispersion strengthened copper alloy serving as the sole means of physical support for said illumination source, said inlead wires extending through said stem press seal and one of said inlead wires further being electrically connected to a fuse lead of a copper solution alloy with nickel and tin external of said press seal region.

7. An electric lamp as in claim 6 wherein said dispersion strengthened copper alloy inleads are further electrically connected to a circuitboard member external of said lamp envelope and said fuse lead is also electrically connected to said circuitboard member.

8. An electric lamp as in claim 6 wherein said dispersion strengthened copper alloy inleads are further joined to dumet metal inleads in the stem press seal region.

9. An electric lamp as in claim 6 wherein the copper solution alloy comprises in weight percent approximately 77% copper, approximately 15% nickel, and approximately 8% tin.

* * * * *